US007316258B2

(12) United States Patent
Thiel

(10) Patent No.: US 7,316,258 B2
(45) Date of Patent: Jan. 8, 2008

(54) METHOD FOR PRODUCTION OF HOLLOW BODIES AND GRINDING BODIES SO PRODUCED

(75) Inventor: Jens-Peter Thiel, Horneburg (DE)

(73) Assignee: Claudius Peters Technologies GmbH, Buxtehude (DE)

( * ) Notice: Subject to any disclaimer, the term of this patent is extended or adjusted under 35 U.S.C. 154(b) by 62 days.

(21) Appl. No.: 10/550,594

(22) PCT Filed: Mar. 10, 2004

(86) PCT No.: PCT/EP2004/002462

§ 371 (c)(1),
(2), (4) Date: Sep. 23, 2005

(87) PCT Pub. No.: WO2004/085097

PCT Pub. Date: Oct. 7, 2004

(65) Prior Publication Data

US 2006/0243413 A1 Nov. 2, 2006

(30) Foreign Application Priority Data

Mar. 25, 2003 (EP) ..... 03006652

(51) Int. Cl.
*B22D 33/04* (2006.01)
*B22C 9/10* (2006.01)

(52) U.S. Cl. ..... 164/137; 164/340; 164/367

(58) Field of Classification Search ..... 164/137, 164/367, 339, 340
See application file for complete search history.

(56) References Cited

U.S. PATENT DOCUMENTS 1,210,421 A * 1/1917 Clark ..... 164/382
3,254,849 A 6/1966 Clements
3,596,703 A * 8/1971 Bishop et al. ..... 164/132

FOREIGN PATENT DOCUMENTS

EP 0894533 A1 2/1999

OTHER PUBLICATIONS

International Preliminary Report on patentability directed to PCT/EP2004/002462.

* cited by examiner

*Primary Examiner*—Kevin P. Kerns
(74) *Attorney, Agent, or Firm*—Morrison & Foerster LLP

(57) ABSTRACT

A method for producing hollow grinding bodies for comminuting material to be ground uses a casting mold having a cavity and includes arranging a core in the cavity with retaining elements to produce a shell-type intermediate space. At least in the area of the intermediate space a metallic material is used as a covering for the retaining elements and fuses with the casting material. The corresponding grinding body has fused-in coverings which improve the rolling behavior of the grinding body produced as only small openings are required to remove the retaining elements. Since the fusing of the metal covering into the edge area of the openings has the effect of a composite casting, even brittle materials do not suffer from chipping.

9 Claims, 1 Drawing Sheet

Fig.1
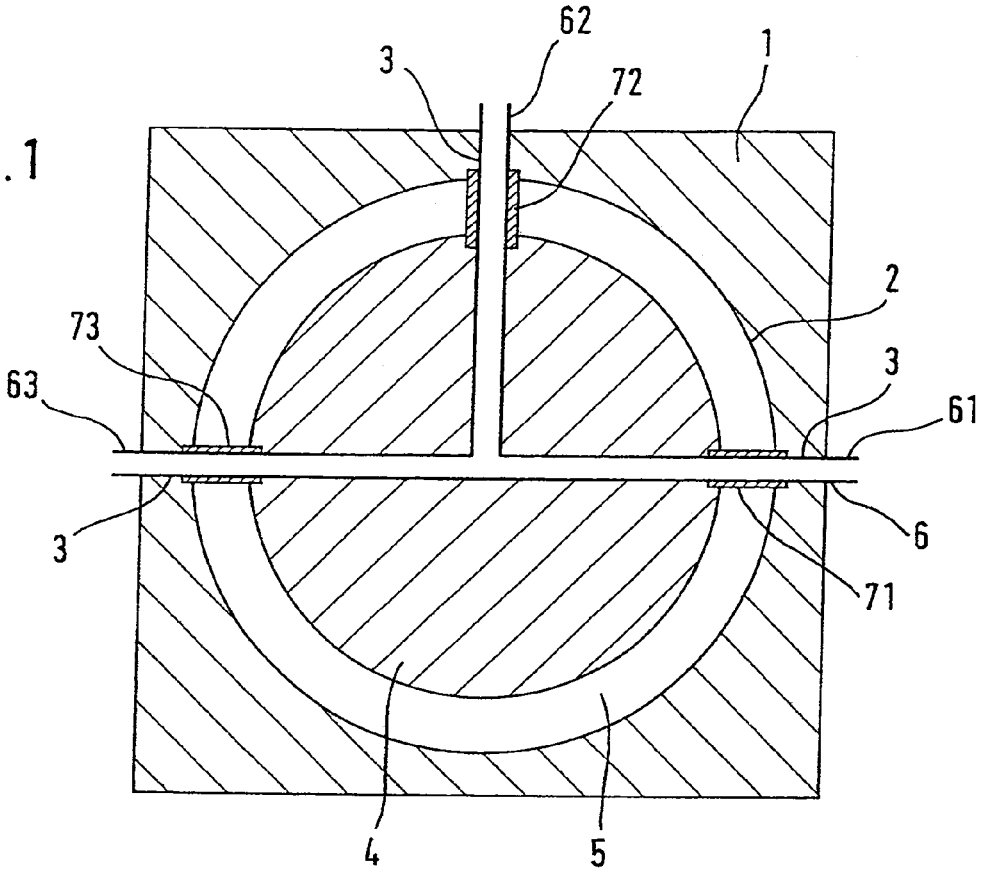
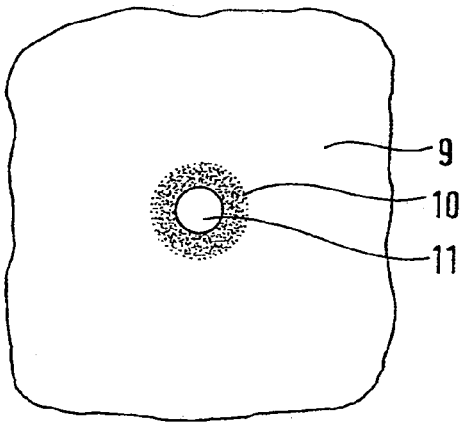
Fig.2
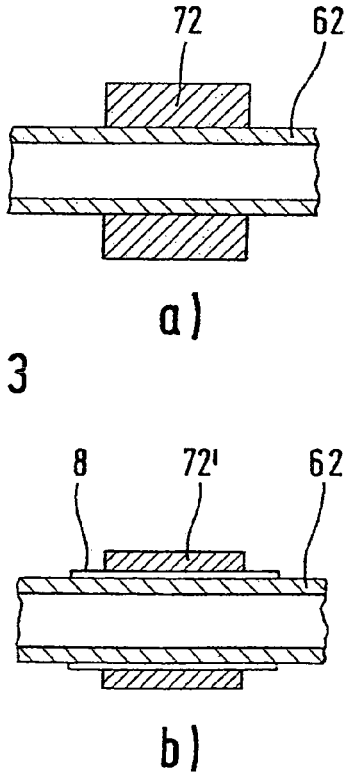
Fig.3

METHOD FOR PRODUCTION OF HOLLOW BODIES AND GRINDING BODIES SO PRODUCED

FIELD OF THE INVENTION

The invention relates to a method for the production of hollow grinding bodies for the comminution of grinding stock, comprising a casting mold with a cavity, the arrangement of a casting core in the cavity, so that a shell-like interspace for casting material is obtained, the introduction of holding elements for the core, the application of a casing onto the holding elements and the pouring of the casting material into the interspace.

BACKGROUND OF THE INVENTION

It is known, for the grinding of cement clinker, cement raw material, coal and similar grinding stock, to use grinding bodies which have a hollow form. The hollow form of the grinding bodies affords the advantage of a considerable weight saving, as compared with solid grinding bodies. One disadvantage is that, where hollow bodies are concerned, because of the limited thickness of the shell, wear is a more serious problem than in the case of solid grinding bodies. So that unnecessarily high wear does not occur, the grinding bodies therefore have to be produced in such a way that they have as low a wear as possible. A production method, known from prior public use, for such hollow grinding bodies is composite casting. For casting, a casting mold is used which has an inner cavity in which a casting core is arranged in such a way that an interspace remains. Casting material is poured into this interspace, so that a shell-like body is obtained after solidification. There is, then, in this case, the difficulty that the casting core has to be fixed in the inner cavity of the casting mold. Furthermore, gases emerging from the casting core have to be discharged. It is known, for this purpose, to hold the core by means of a core supporting structure consisting of steel tubes. The steel tubes are of hollow form, so that gases can be discharged from the core through them. In order to prevent undesirable interactions between the core supporting structure and the casting material, the following methods for protecting the core supporting structure are known from prior public use:

In a first method, the core supporting structure is encased with ceramic material. So that the core supporting structure can be removed from the grinding body after the solidification of the casting material, a plurality of holes are made in the shell of the grinding body. The core supporting structure, together with its ceramic casing, is removed through these. The holes which have thus occurred have a relatively large diameter. During grinding, the edges of these holes obstruct the rolling of the grinding body. What may be referred to as edge bearing occurs. This leads to increased loads on the grinding body, so that it is subjected to increased wear at these points. Particularly where grinding bodies consisting of brittle material are concerned, chipping easily occurs in this region and ultimately may lead to a failure of the grinding body.

In a second method, the tubes of the-core supporting structure are not encased ceramically in the region of the interspace, but, instead, remain unprotected. During the casting operation, they are exposed directly to the casting material. The result of this is that, during the casting operation, there is, at least partially, a fusion of the casting material with the surface of the tubes of the core supporting structure. The core supporting structure is therefore not removed after the solidification of the casting material. It remains in the grinding body. Although edge bearing then also arises during operation, there is no longer any chipping in this region because the core tubes are fused in the same way as in composite casting. The disadvantage of this method is that, on account of the fused-in core tubes the core supporting structure can no longer be removed and is lost.

SUMMARY OF THE INVENTION

The object on which the invention is based is to provide a method of the type initially mentioned and a grinding body produced thereby, by means of which the abovementioned disadvantages are mitigated or avoided.

The solution according to the invention lies in the features as disclosed broadly in this application. Advantageous embodiments are disclosed in more detail below.

According to the invention, in a method for the production of hollow grinding bodies for the comminution of grinding stock, comprising a casting mold with a cavity, the arrangement of a casting core in the cavity, so that a shell-like interspace for casting material is obtained, the introduction of holding elements for holding the core, the application of a casing onto the holding elements and the pouring of the casting material into the interspace, there is provision, at least in the region of the interspace, for using for the casing a metallic material which fuses with the casting material.

The invention is based on the notion that the holding elements for the casting core (these are mostly tubes) are provided with a protective casing which consists of a metallic material, so that they can fuse with the casting material. By contrast, the holding elements themselves can be removed since they are protected by the protective casing against being fused. Two things are achieved thereby. On the one hand, the holes occurring due to the removal of the holding elements are relatively small, since only the holding elements themselves, not their casing too, need to be removed. If only because of the smaller size of the holes, the adverse effects of edge bearing are reduced. In addition, the fusion of the protective casing consisting of metallic material gives rise to a good transition in the region of the holes, so that, even where particularly brittle materials are concerned, chipping does not occur. This results in a particularly good load-bearing behavior of the grinding bodies and consequently in a low wear, along with quiet running. By metallic material being used for the casing, the advantages of a protective casing in terms of the removability of the holding elements can thus be combined in a surprisingly simple way with the benefits of dispensing with the casing and the resulting fusion resembling composite casting.

It has been shown that a particularly good protective effect, on the one hand, and a particularly good fusion behavior, on the other hand, can be achieved by the thickness of the metallic casing being varied locally. An adaption to locally different parameters of the solidification and cooling process can thereby be carried out. A particularly good and largely fault-free fusion of the casing with the casting material can thus be achieved.

It is expedient to apply the metallic casing over a length such that it has an excess length projecting into the region of the casting core and/or of the casting mold. Since the casing consisting of metallic material is not restricted only to the region of the interspace, that is to say of the subsequent zone of fusion with the casting material, what is achieved is that a good fusion result is attained precisely in the especially critical surface region. The freedom from faults in the fusion increases, so that the wear behavior of the grinding body is improved further. It has been shown to be expedient if the excess length amounts to between one and two thirds of the diameter of the holding elements.

In a particularly preferred embodiment, an insulating intermediate layer is produced before the application of the metallic casing. Such an intermediate insulation achieves a better thermal separation between the metallic casing and the holding element itself. This simplifies the management of the method according to the invention in such a way that the metallic casing fuses, free of faults, with the casting material, and, on the other hand, in such a way that the holding element can be removed as easily as possible. Furthermore, the insulating intermediate layer has the advantage that the considerable temperature changes occurring during the casting operation act on the holding elements to only a minor extent, thus counteracting the risk that stresses are introduced into the solidifying casting material due to thermally induced length changes of the holding elements. This improves the dimensional accuracy of the grinding body produced by means of the method according to the invention.

The insulating intermediate layer may also be formed in that the metallic casing sits loosely on the holding elements. In this case, air acts as a particularly simple and effective insulator.

Expediently, the selected cross section both of the holding elements and of the casing is as small as possible. This allows the holes occurring after the removal of the holding elements to be kept as small as possible.

Preferably, in the method according to the invention, the fusion of the metallic casing with the casting material can be checked for freedom from faults by means of ultrasonic methods known per se. This permits a particularly good check of the process parameters of the production method. As a result, all the parameters of the production method, including the dimensions of the holding elements and of the metallic casing, can be optimized.

The invention extends, furthermore, to a grinding body for the comminution of grinding stock, which is in the form of a hollow body and has in its shell orifices for holding elements for holding a casting core, casings of the holding elements being fused in so as to border the orifices, and the fused-in casings consisting of metallic material. On account of the fused-in casings consisting of metallic material, the grinding body according to the invention has in the region of the orifices a structure resembling a composite casting. This affords advantageous properties in terms of edge bearing in the region of the orifices and in terms of the risk to the operating reliability of the grinding body which results from chipping in the region of the orifices.

BRIEF DESCRIPTION OF THE DRAWINGS

The invention is explained below by means of an exemplary embodiment, with reference to the accompanying drawings in which:

FIG. 1 shows a cross section through a casting mold used for the method according to the invention;

FIG. 2 shows an enlarged view of a detail of the surface of a grinding body produced according to the invention, with an orifice in the region of a holding element, in the fused state; and FIG. 3*a, b* show views of details of the casing according to the invention with a holding element, in the unfused state.

DETAILED DESCRIPTION OF THE INVENTION

To explain the method according to the invention, the casting mold used is first described. The casting mold 1 has an inner cavity 2 which is of spherical configuration. The cavity is connected to the surroundings of the casting mold 1 via a plurality of passage bores 3. Furthermore, an inlet (not illustrated) for the introduction of casting material is provided.

Within the cavity 2 is located a spherical casting core 4. The latter is arranged in the cavity 2 in such a way as to give rise, between the surface of the casting core 4 and the surface of the spherical cavity 2, to an interspace which has the same width at every point. The interspace 5 thus acquires the configuration of a spherical shell.

A core supporting structure 6 is provided in order to hold the casting core 4 in its position within the spherical cavity 2. The core supporting structure 6 consists of a plurality of tubes 61, 62, 63 which are plugged into the casting core 4 and are held in the bores 3 of the casting mold 1. The tubes 61, 62, 63 meet in the center of the spherical casting core 4. So that the casting core 4 can be degassed, the tubes 61, 62, 63 are of hollow form. The dimensions of the tubes 61, 62, 63 amount to 75 mm for the outside diameter and to 25 mm for the inside diameter.

In the region of the interspace 5, the tubes 61, 62, 63 are provided with a casing 71, 72, 73 consisting of metallic material. The metallic material may be, for example, various structural steel or boiler plate qualities known per se. The encased region is in this case selected such that it not only runs over the region of the interspace 5, but in each case also extends over some distance into the casting core 4 and the casting mold 1. In the exemplary embodiment illustrated, the length of this distance, also designated as an excess length, amounts to about one third of the outside diameter of the tubes 61, 62, 63.

An enlarged illustration is given in FIG. 3*a* by the example of the tube 62 having the casing 72. The casing 72 surrounds the tube 62 in a ring-like manner. It may sit on the tube 62 tautly or with some play. In the latter case, there is an air gap over a wide range of the circumference between the outer surface of the tube 62 and the casing 72. This air gap has a thermally insulating effect. What is achieved thereby is that the metallic casing 72 can fuse, free of faults, with the casting material introduced into the interspace 5, without the risk that the tube 62 heats up excessively and likewise also fuses. This ensures that the tube 62 can easily be removed from the solidified casting material. To achieve this effect, it is not absolutely necessary to insulate the metallic casing 72 from the core tube 62 by means of an air gap. There may also be provision for applying an insulating material as an intermediate layer 8 in the region between the outer surface of the tube 62 and the metallic casing 72'. This is illustrated in FIG. 3*b*. In this case, too, the advantageous thermal decoupling of the metallic casing 72' from the core tube 62 is obtained.

To produce the grinding body, after the casting core 4 is introduced into the casting mold 1 and positioned at the correct point by means of the core supporting structure 6 and the tubes 61, 62, 63 of the core supporting structure are provided with the metallic casing 71, 72, 73 according to the invention, casting material is introduced through the inlet (not illustrated) into the interspace 5 in the form of a spherical shell, until it completely fills the latter. The casting material cools in the casting mold 1 and solidifies. In this case, fusion occurs with the metallic material of the casings 71, 72, 73 in such a way as to give rise to a composite zone around the core tubes 61, 62, 63. The core tubes 61, 62, 63 themselves do not also fuse. After the solidification of the casting material, they can be removed from the grinding body thus obtained.

FIG. 2 illustrates an enlarged detail of the outer surface of the grinding body 9 produced according to the invention. An orifice 11, through which one of the core tubes 61, 62, 63 has been removed, can be seen. Illustrated diagrammatically in the region surrounding the orifice 11 is an annular zone in which the metallic casing 71, 72, 73 is fused with the casting material. This composite casting zone is designated by the reference symbol 10. By virtue of the invention, the orifice 11 is very small, and it needs to be only so large that it is sufficient for the passage of the core tube 61, 62, 63. The casing 71, 72, 73 surrounding the core tube does not need to be removed, and, according to the invention, it is fused with the casting material. Owing to the small dimensions of the orifice 11, edge bearing in any case occurs to only a slight extent. Moreover, because of the composite zone 10 which is obtained according to the invention, there is scarcely any chipping, even where particularly brittle materials are concerned. The grinding sphere 9 according to the invention thereby achieves outstanding operating and wear properties.

The invention claimed is:

1. A method for production of a hollow grinding body for comminution of grinding stock, comprising providing a casting mold with a cavity formed therein, arranging a casting core in the cavity to produce a shell-like interspace adapted for receiving casting material, introducing holding elements for holding the casting core, applying a separate casing onto the holding elements in the region of the interspace of metallic material which fuses with the casting material, pouring the casting material into the interspace to produce the hollow grinding body, and removing the holding elements.

2. The method as claimed in claim 1, further comprising locally varying the thickness of the metallic casing.

3. The method as claimed in claim 1 or 2, wherein the metallic casing is applied over a length such that an excess length of the metallic casing projects into the region of the casting core or the casting mold.

4. The method as claimed in claim 3, wherein the excess length amounts to between one and two thirds of the diameter of the holding elements.

5. The method as claimed in claim 1 or 2, wherein an air layer is produced as an insulating intermediate layer under the metallic casing.

6. The method as claimed in claim 1 or 2, wherein the metallic material of the casing is structural steel or boiler plate.

7. The method as claimed in claim 1 or 2, wherein a spherical grinding body is produced.

8. A method for production of a hollow grinding body for comminution of grinding stock, comprising providing a casting mold with a cavity formed therein, arranging a casting core in the cavity to produce a shell-like interspace adapted for receiving casting material, introducing holding elements for holding the casting core, applying a separate casing onto the holding elements in the region of the interspace of metallic material which fuses with the casting material, pouring the casting material into the interspace, and applying an insulating intermediate layer to the metallic casing before the pouring of the casting material into the interspace.

9. The method as claimed in claim 8, further comprising locally varying the thickness of the metallic casing.

* * * * *